United States Patent [19]

Varone et al.

[11] Patent Number: 4,536,047

[45] Date of Patent: Aug. 20, 1985

[54] COMMUNICATIONS CONNECTOR SUPPORT BRACKET

[76] Inventors: Richard B. Varone, 81 Hilltop Dr.; Erik W. Svensson, Sr., 19 Oakside Dr., both of Smithtown, N.Y. 11787

[21] Appl. No.: 406,361

[22] Filed: Aug. 9, 1982

[51] Int. Cl.[3] ..... H01R 13/62

[52] U.S. Cl. ..... 339/75 M; 339/198 P; 339/77

[58] Field of Search ..... 339/75 R, 75 M, 77, 339/78, 198 R, 198 P

[56] References Cited

U.S. PATENT DOCUMENTS

| | | | |
|---|---|---|---|
| 3,986,764 | 10/1976 | Torburn | 339/75 M |
| 4,121,808 | 10/1978 | Rollins et al. | 339/75 M |
| 4,157,856 | 6/1979 | Shevchuk | 339/75 R |
| 4,183,606 | 1/1980 | Kies | 339/75 M |

FOREIGN PATENT DOCUMENTS

| | | | |
|---|---|---|---|
| 2740963 | 3/1978 | Fed. Rep. of Germany | 339/75 M |

*Primary Examiner*—Gil Weidenfeld
*Assistant Examiner*—Thomas M. Kline

[57] ABSTRACT

A communications connector support bracket is provided and consists of two vertical support posts each post having a slotted or elongated aperture at top and a clip on bottom whereby each clip may be fastened to a terminal block, a horizontal cross bar having a threaded or non-threaded aperture at each end, the cross bar placed over a plurality of male connectors that are plugged into female connectors that are attached to the terminal block whereby each threaded or non-threaded aperture is in line with each slotted or elongated aperture in each end support post, two star washers each star washer placed in line with each slotted or elongated aperture of each end support post and two screws each screw placed through a star washer and slotted or elongated aperture in a vertical support post and into a threaded or non-threaded aperture in the cross bar so that the cross bar may hold a plurality of male communications connectors securely to the female communications connectors that are attached to said terminal block. A plurality of securing spacers are provided whereby each one is inserted onto the cross bar directly above a short sized male communication connector so that the cross bar can hold a plurality of different size connectors securely to said terminal block.

1 Claim, 9 Drawing Figures

Figure 1
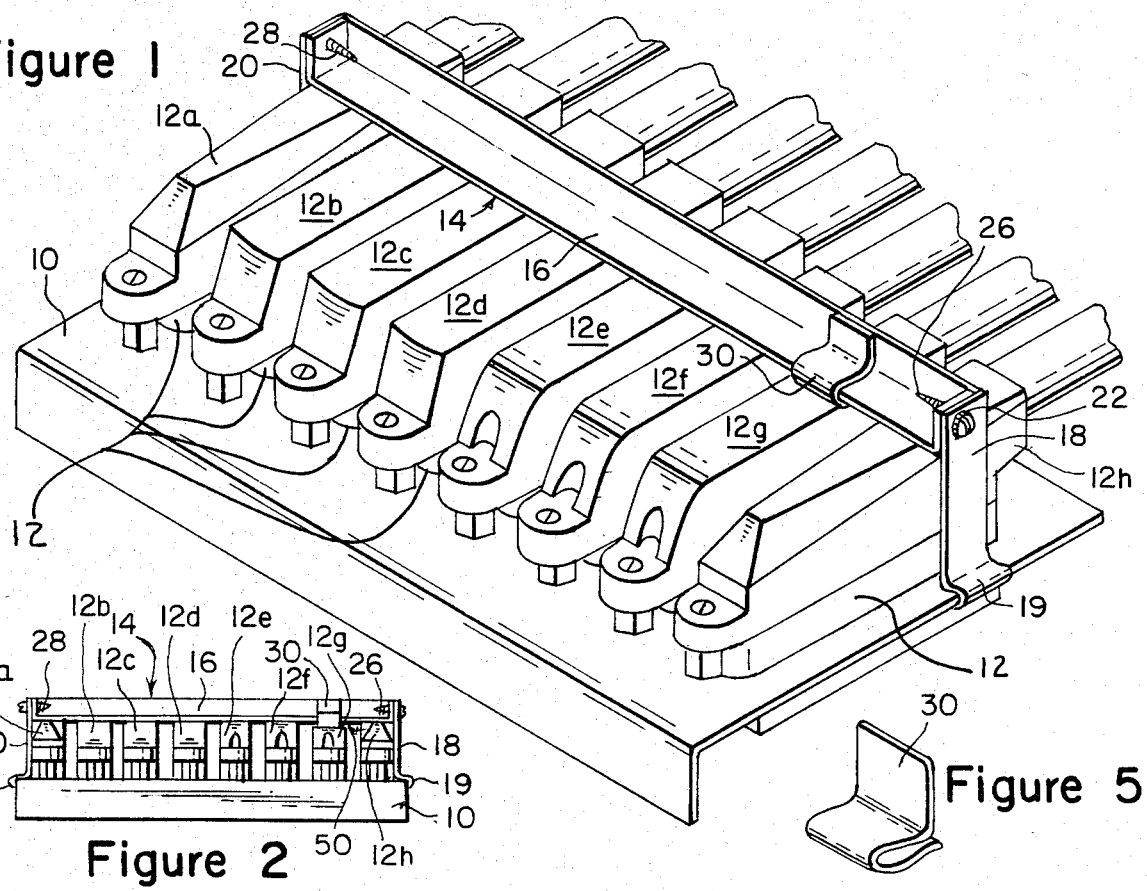
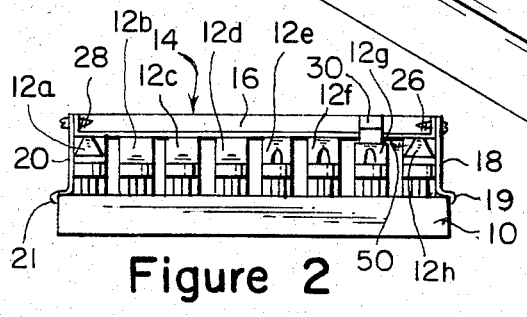
Figure 2
Figure 5
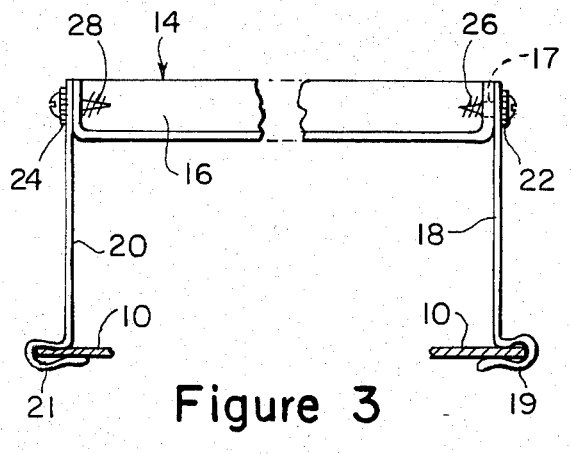
Figure 3
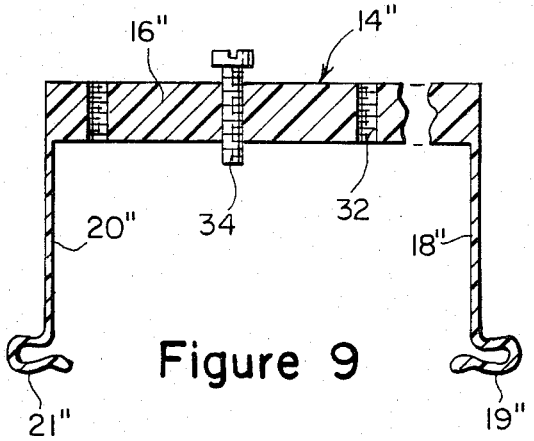
Figure 9
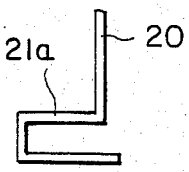
Figure 6
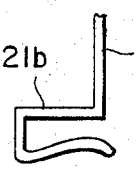
Figure 7
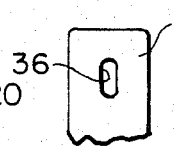
Figure 4
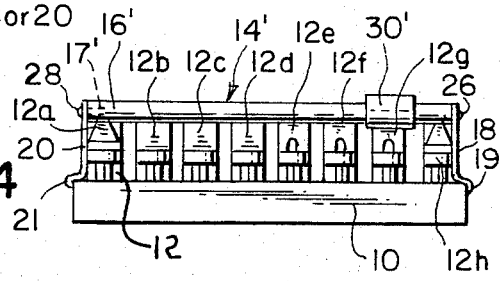
Figure 8

COMMUNICATIONS CONNECTOR SUPPORT BRACKET

BACKGROUND OF THE INVENTION

1. Field of Invention

The instant invention relates generally to communications connectors that are used in the telecommunication industry and more specifically it relates to supporting brackets that will hold together the male and female communications connectors after they are plugged into one another.

2. Description of the Prior Art

The market is void of a means to aid in the securing together of male and female communications connectors in the area of the cable end of said connectors. When said connectors become loose on their mounting block due to vibration and other causes they often times result in a connection becoming interrupted with the result that an open circuit exists which prevents the proper function of said communications connectors. This situation is not desirable and accordingly is in need of an improvement.

SUMMARY OF THE INVENTION

The communications connector support bracket consists of two vertical support posts each having a clip on the bottom, a horizontal cross bar, two star washers and two screws. Each screw is placed through a star washer, a slotted or elongated aperture in the support post and a threaded or non-threaded aperture in the crossbar. The entire bracket is placed over the assembled male and female communications connectors and clip onto the mounting block. A plurality of securing spacers can be placed on the cross bar so that a plurality of different size connectors may be secured onto the mounting block.

A principle object of the present invention is to provide a communications connector support bracket that will secure all male and female communications connectors without allowing any to come loose once they have been plugged together and mounted to the mounting block.

Another object is to provide a communications connector support bracket that will secure different size male and female communications connectors without allowing any to come loose once they have been plugged together and mounted to the mounting block.

An additional object is to provide a communications connector support bracket that is safe to use by not damaging the male and female communications connectors when placed in position.

A further objects is to provide a communications connector support bracket that is economical in cost to manufacture.

A still further object is to provide a communications connector support bracket that is easy to install and use.

Further objects of the invention will appear as the description proceeds.

DESCRIPTION OF THE DRAWINGS

FIG. 1 is a perspective view of the invention in use.

FIG. 2 is a front elevational view of the invention in use.

FIG. 3 is a front elevational view of the invention with parts broken away.

FIG. 4 is a detail view of the top of a vertical support post showing a slotted/elongated aperture.

FIG. 5 is a perspective view of a clip securing spacer.

FIG. 6 is a detail view of an alternate clip used on a vertical support post.

FIG. 7 is a detail view of another alternate clip used on a vertical support post.

FIG. 8 is a front elevational view of another embodiment of the invention in use.

FIG. 9 is a front cross sectional view of still another embodiment of the invention.

DESCRIPTION OF THE PREFERRED EMBODIMENTS

Turning now descriptively to the drawing in which similar reference characters denote similar elements throughout the several views, FIGS. 1 through 3 illustrate a communications connector support bracket 14. Said bracket 14 is fastened to terminal block 10 having a plurality of female connectors 12 and male connectors 12*a* through 12*h*. In these drawings terminal block 10 is adapted to accept eight connector sets but it may also be used on any amount of connector sets (from one or more).

The bracket 14 consists of two vertical support posts 18 and 20 with each having a slotted or elongated aperture 36 at the top as best seen in FIG. 4. Post 18 has a clip 19 on the bottom and post 20 has a clip 21 on the bottom so that clips 19 and 21 may be fastened to the terminal block 10.

A horizontal cross bar 16 may have a threaded or non-threaded aperture 17 at each end. The cross bar 16 is placed over the plurality of male connectors 12*a* through 12*h* that are plugged into female connectors 12 that are affixed to mounting block 10 and each threaded or nonthreaded aperture 17 is in line with each slotted or elongated aperture 36 in each end support post 18 and 20. Two star washers 22 and 24 and two screws 26 and 28 are provided. Screw 26 is placed through star washer 22, a slotted or elongated aperture 36 in the vertical support post 18 and into the threaded or non-threaded aperture 17 in the cross bar 16. Screw 28 is placed through star washer 24, a slotted aperture 36 in the vertical support post 20 and into the non-threaded or threaded aperture 17 in the cross bar 16. The cross bar 16 can hold a plurality of male/female connectors onto terminal block 10.

The cross bar 16 is an L-shaped angle with each extended end bent in an upward position having the non-threaded or threaded aperture 17 therein. A clip securing spacer 30 as best seen in FIG. 5 can be inserted onto a horizontal arm of the cross bar 16 directly above a short size male connector 12*g* to take up the space 50 (FIG. 2) so that the cross bar 16 can hold the small size male connector 12*g* with the other male connectors 12*a*, 12*b*, 12*c*, 12*d*, 12*e*, 12*f* and 12*h* secure on the terminal block 10. If more than one male connector is small other clip securing spacers 30 can be inserted onto the cross bar 16 when needed.

The communications connector support bracket 14 and clip securing spacer 30 are completely made of metal but can be made of plastic or any other durable material.

FIG. 6 is a detail view of another type of clip 21*a* that can be used on the vertical support post 20 while FIG. 7 is a detail view of still another type of clip 21*b* that can be used on the vertical support post 20. It is understood that these two types of clips (not shown as they are mirror images of clips 21*a* and 21*b*) may also be used on vertical support post 18 and function in a similar manner as clips 19 and 21.

FIG. 8 is similar to FIG. 2 except that the communications connector support bracket 14' has a cross bar 16' that is a rod circular in shape having a non-threaded or threaded aperture 17' at each end. The securing spacer 30' is a tubular sleeve that can be inserted onto the cross bar 16' directly above a short size male connector 12*g* so that the cross bar 16' can hold the small size male connector 12*g* with the other male connectors 12*a*, 12*b*, 12*c*, 12*d*, 12*e*, 12*f* and 12*h* secure to said terminal block 10. If more than one male connector is small other tubing sleeve securing spacers 30' can be inserted onto the cross bar 16' when needed.

The cross bar 16' and the securing spacer 30' can be made of nylon, plastic, metal or any other durable material.

FIG. 9 shows a communications connector support bracket 14'' that consists of a horizontal solid cross bar 16'' having a plurality of equal spaced vertical threaded apertures 32 therethrough. The cross bar 16'' is placed over a plurality of male connectors that are plugged into the terminal block (not shown).

Two vertical support posts 18'' and 20'' each have a top affixed at a right angle to an end of the cross bar 16''. Vertical support post 18'' contains clip 19'' on the bottom and vertical support post 28'' contains clip 21'' on the bottom. Each clip 19'' and 21'' can be fastened to terminal block 10 so that the cross bar 16'' can hold a plurality of connectors securely onto terminal block 10 (not shown).

A plurality of adjustment securing screws 34 (just one shown in FIG. 9) can each be threaded into a threaded aperture 32 in the cross bar 16'' directly above a short size male connector so that the cross bar 16'' can hold a plurality of different size male communication connectors securely to terminal block (not shown).

The support arms 18'' and 20'' can be fabricated from separate pieces affixed to the cross bar 16'' or can be integral with the cross bar 16'' as shown in FIG. 9. Said communications connector support bracket 14'' may be made out of plastic but may also be made out of metal or other durable material.

While the form of apparatus herein described constitutes a preferred embodiment of the invention, it is understood that the invention is not limited to this precise form of apparatus and that changes may be made therein without departing from the scope of this invention.

Having regard to the foregoing disclosure the following is claimed as the inventive and patentable embodiments thereof:

1. A communications connector support bracket mounted to a terminal block for keeping male and female communications connectors from becoming loose which comprises:

(a) two vertical support posts each having a top end and a lower end, said top end having an elongated aperture, said lower end having a clip fastening means for securing each of said support posts to said terminal block, said clip fastening means comprising a C-shaped member extending from said lower end of each of said support posts;

(b) cross bar means comprising a horizontal element extending in a plane parallel to said terminal block and a vertical element extending perpendicularly from said horizontal element, said horizontal element and said vertical element forming an L-shaped member, said horizontal element having at each end thereof an extension member, each of said extension members being bent in an upward direction so as to be perpendicular to said horizontal element and said vertical element, each of said extension members being provided with a central hole;

(c) means to align said central hole of each of said extension members with said elongated aperture provided on each of said support posts and to fasten said cross bar means to said support posts to hold the male connectors in engagement with the female connectors;

(d) at least one securing spacer, said securing spacer comprising a U-shaped resilient clip member and a lateral foot member, said U-shaped clip member being resiliently secured onto said horizontal element and the lateral foot member being in abutting engagement with the vertical element of said cross bar means, and said U-shaped clip member being selectively positionable above and resiliently engagable with at least one of said male connectors whereby said cross bar means can hold a plurality of male communications connectors of different heights securely onto said terminal block.

* * * * *